US005804962A

United States Patent [19]

Kather et al.

[11] Patent Number: 5,804,962

[45] Date of Patent: Sep. 8, 1998

[54] METHOD OF ADJUSTING THE POSITION OF REST OF AN ARMATURE IN AN ELECTROMAGNETIC ACTUATOR

[75] Inventors: Lutz Kather, Würselen; Ekkehard Schrey; Günter Schmitz, both of Aachen, all of Germany

[73] Assignee: FEV Motorentechnik GmbH & Co. KG, Aachen, Germany

[21] Appl. No.: 694,247

[22] Filed: Aug. 8, 1996

[30] Foreign Application Priority Data

Aug. 8, 1995 [DE] Germany ..... 195 29 154.9

[51] Int. Cl.[6] ..... H01F 7/121; F01L 9/04; F16K 31/02; G01B 7/00

[52] U.S. Cl. ..... 324/207.16; 123/90.11; 251/129.16; 251/129.18; 324/207.18; 361/160; 335/258

[58] Field of Search ..... 324/415, 418, 324/202, 207.16, 207.18, 207.19, 207.22, 207.24; 335/256, 258; 123/90.11; 137/554; 251/129.1, 129.15–129.18; 340/644, 686; 361/160, 170, 187, 206

[56] References Cited

U.S. PATENT DOCUMENTS

| | | | |
|---|---|---|---|
| 3,789,876 | 2/1974 | Kempton et al. | 137/554 |
| 4,950,985 | 8/1990 | Voss et al. | 324/207.16 |
| 5,202,628 | 4/1993 | Locher et al. | 324/207.16 X |
| 5,283,519 | 2/1994 | Patzig | 324/207.19 |
| 5,583,434 | 12/1996 | Moyers et al. | 324/207.16 |

FOREIGN PATENT DOCUMENTS 30 24 109 9/1989 Germany .

*Primary Examiner*—Gerard R. Strecker
*Attorney, Agent, or Firm*—Spencer & Frank

[57] ABSTRACT

A method of ascertaining the position of rest assumed by a movable armature, in response to forces of oppositely acting return springs, between two deenergized electromagnets. The method includes the following steps: measuring the inductivities of the two electromagnets; comparing the measured inductivity values to obtain a comparison value; and ascertaining the position of the armature in the position of rest between the two electromagnets from the comparison value.

4 Claims, 1 Drawing Sheet

METHOD OF ADJUSTING THE POSITION OF REST OF AN ARMATURE IN AN ELECTROMAGNETIC ACTUATOR

CROSS REFERENCE TO RELATED APPLICATION

This application claims the priority of German Application No. 195 29 154.9 filed Aug. 8, 1995, which is incorporated herein by reference.

BACKGROUND OF THE INVENTION

In electromagnetic actuators used, for example, in internal combustion engines for actuating the cylinder valves, high switching speeds and large switching forces are simultaneous requirements. For operating cylinder valves in internal combustion engines, an electromagnetic actuator has an armature connected with a setting member, such as the cylinder valve. The armature is held by return springs in a position of rest between a valve-closing electromagnet and a valve-opening electromagnet. By energizing one of the electromagnets, the armature is, from its position of rest, pulled to the energized electromagnet and is held there for the duration of the energized state. Thus, dependent on whether the opening or closing electromagnet is energized, the armature is held in the respective "valve closed" or "valve open" position.

For operating a cylinder valve, that is, for initiating its motion from the closed position into the open position and conversely, the holding current of the then-holding magnet is interrupted. As a result, the holding force of the respective electromagnet falls below the spring force of the return spring, and the armature begins its motion, accelerated by spring force. After the armature traverses the position of rest, its motion is braked by the spring force of the oppositely located return spring. In order to capture and hold the armature in the opposite position, the electromagnet at that location is energized.

The use of electromagnetic actuators for cylinder valves has the advantage that an adaptable control for the intake and exhaust gases is possible so that the operating process may be optimally affected by parameters desired for the operation. The control process has a significant effect on the various operational parameters, for example, the condition of the gases in the intake zone, in the combustion chamber and in the exhaust zone as well as the operational sequences in the combustion chamber itself. Since internal combustion engines operate in a non-stationary manner under widely varying operational conditions, a variable control of the cylinder valves is of advantage. Such an electromagnetic switching arrangement for cylinder valves is disclosed, for example, in German Patent No. 3,024,109.

A significant problem involved with the control of electromagnetic actuators of the above-outlined type is the timing accuracy which is required in particular for a control of the engine output for intake valves of an internal combustion engine. An exact control of the timings is rendered difficult by manufacturing tolerances, by wear phenomena during operation as well as by various operational conditions such as changing load requirements and changing operational frequencies because these external influences may affect time-relevant timing parameters of the system. A condition for an accurate and reliable operation of the cylinder valves is an exact setting of the position of rest of the armature in the middle between the two electromagnets when they are in a deenergized state.

SUMMARY OF THE INVENTION

It is an object of the invention to provide an improved method for ascertaining and adjusting the position of rest of an actuator armature of the above-outlined type which makes possible an automatic setting of the armature position.

This object and others to become apparent as the specification progresses, are accomplished by the invention, according to which, briefly stated, the method of ascertaining the position of rest assumed by a spring-biased armature between two deenergized electromagnets includes the following steps: measuring the inductivities of the two electromagnets; comparing the measured inductivity values to obtain a comparison value; and ascertaining the position of the armature in the position of rest between the two electromagnets from the comparison value.

The method outlined above advantageously utilizes the direct effect of the position of the armature between the two magnets on the inductivity of the coils of the electromagnets. If it is determined that the position of rest of the armature must be at the mid point between the two pole faces of the electromagnets of the electromagnetic actuator to be measured, then it may be assumed that for an identical layout of the coils of the two electromagnets, the armature will be in the mid position, corresponding to the position of rest, if the two measured inductivity values are identical. If a deviation in inductivity is determined, the assumption may be made that the armature is not in the mid position.

An existence of the above-noted deviation would mean that because of the unlike distances of the armature from the pole faces of the one and the other electromagnet, unlike forces have to be overcome by the return springs. These forces are composed of the decaying holding current upon deenergization of the holding magnet and by the buildup of the capturing current upon energization of the oppositely-located capturing magnet. For these reasons an offset location of the position of rest of the armature causes inaccuracies in the timing of the sequence of armature motion. By changing the bias of the return springs with an appropriate setting mechanism to so adjust the position of rest of the armature that the measured inductivity values are identical for both electromagnets, then the armature assumes the mid position between the two electromagnets for the respective force effects in its position of rest. This measure, however, involves the assumption that both electromagnets are structurally identical and also have identical inductivities. Since the measurement is performed electrically, a corresponding setting signal may be generated by means of a desired value/actual value comparison with a predetermined value. The setting signal may be used to provide a visual indication, based on which a manual adjustment of the position of rest may be carried out. In a similar manner, however, the setting signal may be applied by an automatically operating setting device with which an automatic adjustment of the position of rest is feasible. Such a method may be performed either in the course of a diagnostical analysis of an internal combustion engine or during the manufacture of the electromagnetic actuators. In this process it is expedient—to avoid large tolerance deviations—to measure the inductivity of the individual electromagnets as early as during their manufacture (thus, before assembling the electromagnetic actuator) and to gather for assembly those electromagnets which match within the corresponding tolerance field.

The method according to the invention may also find application in cases where the return springs having different spring characteristics and/or different bias settings are used for the purpose of predetermining a position of rest which deviates from the geometrical mid location between the two pole faces. Similar considerations apply if for certain operational modes electromagnets with different inductivities are used. In such a case, when comparing the two measured inductivity values, a predetermined measuring value difference has to be observed if the armature is to assume a predetermined position of rest.

According to another embodiment of the method of the invention, the armature is caused to engage the one and the other pole faces and then the inductivity of the respective electromagnet is measured while the armature is held thereagainst, and the measuring value and/or the difference between the two measuring values is compared with a predetermined measuring value and from the result a correcting value for a setting signal is derived. Such a predetermined measuring value or a deviation from a predetermined measuring value and/or a setting signal derived therefrom may be utilized for calibrating the actuator since the two inductivities measured while the armature engages the respective pole faces have to be at the same ratio relative to one another as in the predetermined position of rest. The armature may be retained in its magnet-engaging position by mechanical means and/or by a holding current applied to the respective electromagnet.

DESCRIPTION OF THE PREFERRED EMBODIMENTS

Figure 1:
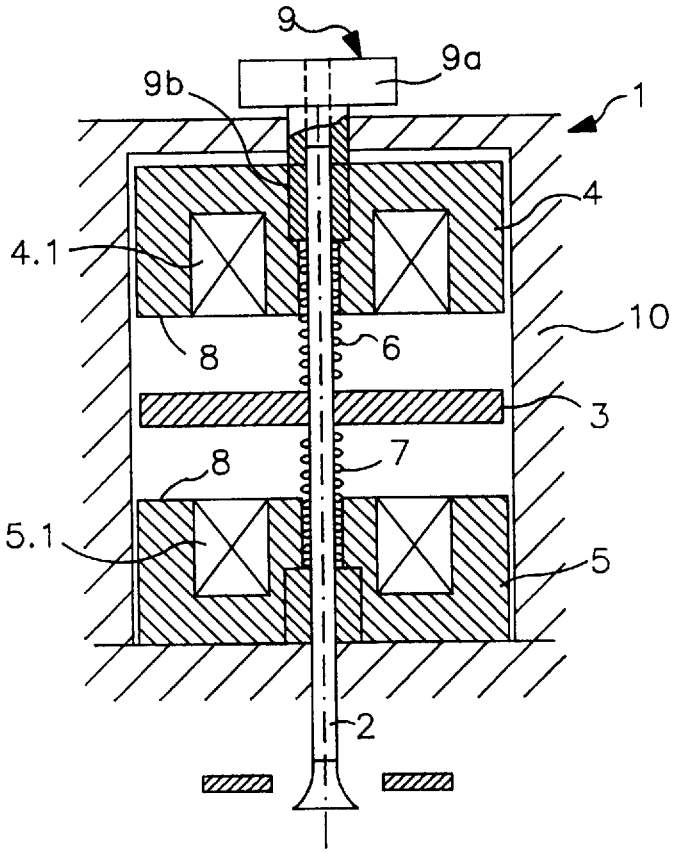
FIG. 1 is a schematic sectional elevational view of an actuator for performing the method according to the invention.

FIG. 1 shows an electromagnetic actuator generally designated at 1 having an armature 3 coupled to an engine-cylinder valve 2 as well as a closing magnet 4 supporting a solenoid 4.1 and an opening magnet 5 supporting a solenoid 5.1. The armature 3 is, in the deenergized state of the electromagnets 4 and 5, maintained in a position of rest by return springs 6 and 7 between the two magnets 4 and 5. The distance of the position of rest from the pole faces 8 of the magnets 4 and 5 depends from the design and/or setting (layout) of the return springs 6 and 7. In the illustrated embodiment the two springs 6 and 7 are of identical layout; as a result, the position of rest of the armature 3 is in the middle between the two pole faces 8 as shown in the Figure.

It is assumed that the return springs 6 and 7 have identical spring characteristics so that a precise geometrical mid position between the two pole faces 8 may be set as a position of rest by means of a setting mechanism 9 which adjusts the spring bias. The setting mechanism 9 includes an adjusting knob 9*a* attached to an axially hollow, externally threaded shaft 9*b*, engaging an internally threaded bore portion of the magnet 4.

In the closed position of the cylinder valve 2, the armature 3 lies against the pole face 8 of the closing magnet 4. To operate the cylinder valve 2, that is, for initiating its motion from the closed position to the open position, the holding current flowing through the closing magnet 4 is interrupted. As a result, the holding force of the closing magnet 4 falls below the spring force of the return spring 6 and the armature 3 begins its motion, accelerated by the spring force. After the armature 3 has traversed the mid position between the two magnets which, in case of a deenergized state of the magnets also corresponds to the position of rest of the armature, the motion of the armature is braked by the spring force of the return spring 7 associated with the opening magnet 5. To be able to capture and hold the armature 3 in the open position, the opening magnet 5 is energized so that the armature 3 comes to rest against the pole face 8 of the opening magnet 5 and is held in that position for the intended duration of the "valve open" period. For closing the cylinder valve 2, the above-described switching and motion sequences occur in a reverse order.

If, because of manufacturing reasons, the characteristics of the two return springs 6 and 7 are different, the position of rest of the armature 3 deviates from the required geometrical mid position between the two electromagnets 4 and 5 so that different air gaps and thus different magnetic force effects are obtained which act on the armature 3 and thus, as a result, the periods of motion in the two directions of armature displacement are not exactly the same.

By shifting the armature 3 by means of the setting mechanism 9 into the exact mid position relative to the two pole faces of the electromagnets 4 and 5, the difference in the inductivity for the two electromagnets may be compensated for in the position of rest and thus identical attracting conditions are established.

It is, however, also feasible to shift one or both magnets 4 and 5 by appropriate setting mechanisms relative to the armature 3 for setting the exact mid position while the spring bias remains unchanged. Since the two electromagnets 4 and 5 are supported in a housing 10, it is structurally feasible to shift one or both magnets 4 and 5 relative to the armature 3 by maintaining the bias of the return springs 6 and 7 unchanged so that, related to the armature, for the two electromagnets 4 and 5 identical inductivity conditions are obtained.

Figure 2:
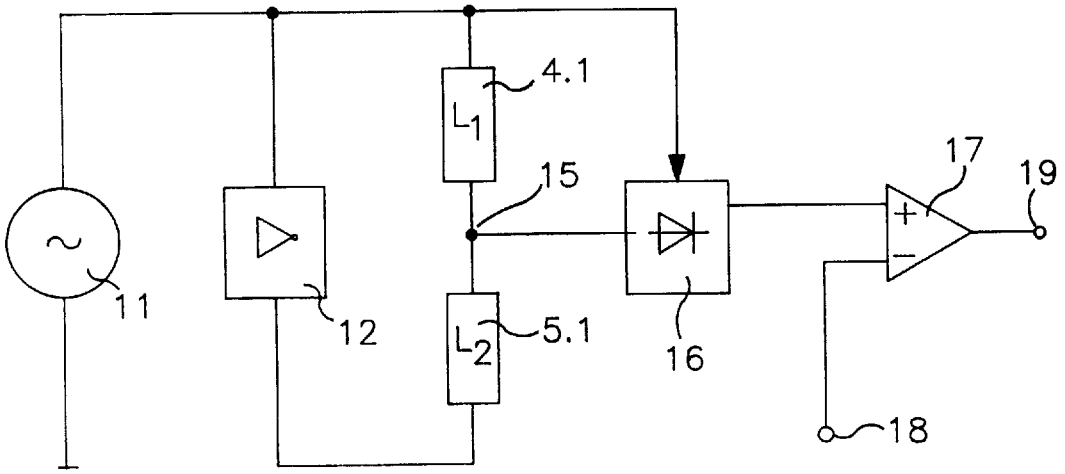
FIG. 2 is a block diagram of a circuit for measuring the inductivity of the electromagnets of the actuator shown in FIG. 1.

FIG. 2 schematically illustrates a circuit for measuring the inductivity of the electromagnets 4 and 5 of the actuator 1 and more particularly, for generating a voltage which is proportional to the deviation of the position of rest of the armature 3 from a desired position of rest and from which the position of the armature 3 may be derived.

An a.c. voltage source 11 generates an approximately sinusoidal voltage, for example, $\hat{u}_1(t)=\hat{u}.\sin(\omega t)$. From this voltage an inverter 12 connected to the voltage source 11 generates a voltage of opposite phase, that is, $\hat{u}_2(t)=-\hat{u}.\sin(\omega t)$. These two voltages are applied to the two solenoids 4.1 and 4.2 of the actuator. The respective other terminals of the solenoids 4.1 and 5.1 are connected to one another at a junction 15 which, in turn, is connected to a synchronous rectifier 16 which phase-wise rectifies the voltage at the junction 15 with the aid of the reference voltage taken from the voltage source 11. The d.c. voltage obtained in this manner is applied to a difference former 17 which subtracts the desired value appearing at the input 18 from the d.c. voltage. As a result, at the output 19 a signal appears which represents the deviation of the position of rest of the armature 3 from a desired position represented by the signal at the input 18.

The circuit described in connection with FIG. 2 operates in the following manner: at the junction 15 a voltage $\hat{u}_{15}=(L1-L2)/(L1+L2).\ \hat{u}_{11}$ appears, where L1 is the inductivity of the solenoid 4.1 and L2 is the inductivity of the solenoid 5.1. At the output of the synchronous rectifier 16 a d.c. voltage $U_{16}=(L1-L2)/(L1+L2).\ u_{11}$ appears; this voltage represents the difference between the inductivities L1 and L2 including the corresponding signs. If the two inductivities are identical, the voltage is zero which corresponds to an exact mid position of the armature 3. If for certain reasons a position of rest other than a mid position is desired for the armature, or if, because of manufacturing reasons or technical necessities the inductivities of the solenoids are initially not identical, a desired value is applied to the input 18. Such a desired value is set to a magnitude which corresponds to the difference in inductivities for the desired position of rest of the armature.

The voltage at the output 19 may be used to provide a visual indication and based thereon a manual setting may be effected by an appropriate device, such as the setting mechanism 9. It is also feasible, however, to perform a controlled or automatic adjustment of the position of rest of the armature by providing the setting mechanism 9 with an appropriate setting drive.

It will be understood that the above description of the present invention is susceptible to various modifications, changes and adaptations, and the same are intended to be comprehended within the meaning and range of equivalents of the appended claims.

What is claimed is:

1. A method of ascertaining the position of rest of a movable armature of an electromagnetic actuator for an engine cylinder valve, assumed between two de-energized electromagnets in response to forces of oppositely acting return springs, and adjusting the position of rest relative to first and second electromagnets, comprising the following steps:

(a) measuring the inductivities of said first and second electromagnets;

(b) comparing the measured inductivity values to obtain a comparison value;

(c) ascertaining the position of the armature in the position of rest between said first and second electromagnets from the comparison value; and (d) adjusting at least one of (1) a bias of at least one of said return springs and (2) a position of at least one of said first and second electromagnets relative to said armature until the comparison value equals a desired inductivity value predetermined for said position of rest.

2. The method as defined in claim 1, further comprising the step of generating a setting signal as a function of said comparison value; further wherein said adjusting step includes the step of adjusting the position of rest relative to the first and second electromagnets by said setting signal.

3. The method as defined in claim 1, further comprising the step of maintaining said armature in the position of rest during performance of said measuring step.

4. The method as defined in claim 1, wherein said measuring step comprises the steps of (a) moving said armature into contact with a pole face of said first electromagnet;

(b) measuring the inductivity of said first electromagnet while said armature is in contact therewith;

(c) moving said armature into contact with a pole face of said second electromagnet;

(d) measuring the inductivity of said second electromagnet while said armature is in contact therewith; and (e) comparing the measured inductivity values with a given value to obtain a correction value; and further comprising the step of generating a setting signal as a function of said correction value and performing said adjusting step by said setting signal.

* * * * *